United States Patent [19]

Rusconi

[11] Patent Number: 4,711,204

[45] Date of Patent: Dec. 8, 1987

[54] APPARATUS AND METHOD FOR COLD WEATHER PROTECTION OF LARGE DIESEL ENGINES

[76] Inventor: David M. Rusconi, P.O. Box 2846, Redwood City, Calif. 94064

[21] Appl. No.: 521,436

[22] Filed: Aug. 8, 1983

[51] Int. Cl.[4] ..... F02N 17/02

[52] U.S. Cl. ..... 123/142.5 R; 123/41.44; 237/12.3 B; 237/2 A; 122/26

[58] Field of Search ..... 126/247; 122/26; 237/1 R, 12.3 R, 12.3 C; 123/142.5 R, 41.44

[56] References Cited

U.S. PATENT DOCUMENTS

| | | | |
|---|---|---|---|
| 2,720,194 | 1/1955 | Dilworth | 123/41.44 |
| 2,794,601 | 6/1957 | Steadman et al. | 237/12.3 C |
| 3,304,004 | 7/1967 | Hraboweckyj | 237/12.3 |
| 3,373,728 | 3/1968 | Collins | 123/142.5 |
| 3,758,031 | 2/1973 | Moran | 237/8 A |
| 4,051,825 | 6/1977 | Elder | 123/142.5 R |
| 4,192,274 | 3/1980 | Damon | 123/142.5 R |
| 4,264,826 | 4/1981 | Ullmann | 122/26 |
| 4,305,354 | 2/1981 | Majkrzak | 123/142.5 R |
| 4,409,927 | 10/1983 | Loesch et al. | 122/26 |
| 4,424,775 | 1/1984 | Mayfield, Jr. et al. | 123/142.5 R |
| 4,458,633 | 7/1984 | Loesch et al. | 122/26 |

FOREIGN PATENT DOCUMENTS 157903 4/1921 United Kingdom .

OTHER PUBLICATIONS

An Answer to Locomotive Idling? Railway Age Aug. 9, 1982, p. 18.

*Primary Examiner*—Henry Bennett

*Attorney, Agent, or Firm*—Marshall C. Gregory

[57] ABSTRACT

An apparatus particularly adapted to installation in large railroad diesels or other large diesel applications which provides heated coolant for circulation in the large engine during shutdown or layover periods, also providing heat for accessories and electrical charge for batteries. Main engine fuel supply is used to run a small diesel engine which drives an inverter and a centrifugal pump, the discharge of which is severely stifled or throttled, the inefficiency of the pumping action converting much of the energy of the pump into heat absorbed in the coolant which is then pumped through the regular cooling lines in reverse flow, and to accessories as desired.

12 Claims, 5 Drawing Figures

APPARATUS AND METHOD FOR COLD WEATHER PROTECTION OF LARGE DIESEL ENGINES

FIELD OF THE INVENTION

The present invention relates to an apparatus and method for providing, in cold weather, thermal energy to the engine coolant of a diesel engine which is in a standby or non-operating status. While it is particularly intended for use in railroad diesels on standby in very cold weather, it should also be applicable to other diesel powered vehicles or to stationary diesels such as standby or emergency electrical generating equipment or engines for mechanical power. The invention as designed takes its fuel directly from the main diesel fuel supply; with its own fuel supply it could be applicable to large gasoline engines as well.

BACKGROUND AND PRIOR ART

In operating diesel powered equipment in cold weather, problems arise with starting cold engines. When the temperature drops below 40° F. approximately (about +4° to 5° C.), starting the engine may become difficult. If the temperature is significantly lower than that, starting engines by conventional means may become essentially impossible, and damage to starters and internal mechanical components may result from forced starting. There is the additional problem that it is common practice in railroad diesel equipment to use water without anti-freeze (there may be other additives, but the freezing characteristics are still those of plain water) as the coolant for the engine, so that the temperature of the coolant must not be allowed to drop very far below 32° F. (0° C.), if at all.

Particularly in severe weather areas, then, it has been common practice to continuously run standby or layover diesel equipment at idle or low speeds. This has number of obvious disadvantages: not only is the cumulative expense of the wasted fuel a very significant cost item; the useless waste of precious petroleum resources is of great concern; long periods of running at low speeds can result in internal damage from improper lubrication of the cylinder walls; combustion is relatively inefficient, so that there is a disproportionate increase in the generation of atmospheric pollutants, and finally of course there is the noise factor which may be of considerable concern, as the incessant beat of a large diesel engine at idle can be most irritating.

There have been many devices proposed to provide auxiliary energy supply for standby or parked vehicles of all sorts. Among the approaches taken have been heaters fired by propane/butane type fuels, heaters with separate fuel supplies of liquid fuel, auxiliary electrical generating equipment which then provides energy to electrical heaters, and other methods. Another form has been the use of a second engine or vehicle, which in one application (U.S. Pat. No. 4,305,354 Dec. 15, 1981, to Majkrzak) uses quick coupling connections to interconnect the liquid coolant systems of the two engines, so that the operating engine will pump its heated coolant into the cold engine on an interchange basis, and the cold engine can then be started. A variation of this same approach is taught in U.S. Pat. No. 4,051,825, Oct. 4, 1977, to Elder. A still further variation is described in U.S. Pat. No. 3,373,728, Mar. 19, 1968 to Collins, in which the second or starter engine provides thereon a heat exchanger, to which the coolant system of the cold engine is connected, to heat up its coolant without actual interchange of fluids between the two engines. In this patent to Collins, it is envisioned that a tow truck or similar vehicle will have the heat exchanger mounted thereon.

A United States Patent issued Feb. 14, 1967 to Hraboweckyj describes an auxiliary heater fueled by butane, to be permanently mounted on the frame of a highway tractor, which provides for cab heat as well as a heat exchanger for the engine coolant. Advantages claimed for this particular approach include simplicity, operation essentially without moving parts, use of natural draft, quiet operation and lower pollution. There are, however, some restrictions on movement through tunnels and other places applicable to vehicles with butane or propane tanks.

In recent years, two U.S. Patents have issued for devices which provide complete units, designed to use the main vehicle diesel fuel supply, and separate thermal generators, to provide auxiliary heat, each intended to be permanently affixed to the subject vehicle. In U.S. Pat. No. 3,758,031, to Moran, a small boiler is provided, with a conventional furnace type pressure fuel burner, to provide heated fluid, which is then interconnected with the vehicle engine coolant system, as well as with a radiator system in the cab. This unit is designed for highway diesel rigs, to be mounted on the tractor frame. In U.S. Pat. No. 4,192,274, Mar. 11, 1980, to Damon, the system layout is essentially the same as taught in Moran, except that the heater system provided is an element of the novelty claimed, being a specially designed oil pressure burner design. A principal focus of this patent is the control system for operation of the system.

There has been recent development interest in systems to provide for maintaining the coolant of standby or non-operating engines at a temperature above the ambient. The escalation of fuel prices over the past few years has heightened the activity in this field, and there are several small auxiliary systems being offered which tend generally to be small motor-generator systems allied with immersion or wrap-around electric heaters.

One of these is the LTP system, (for low temperature protection), being offered by Microphor, Inc, of Willits, Calif., on which U.S. Pat. No. 4,424,775 has issued. The patent teaches a small auxiliary diesel engine providing thermal energy to the coolant and engine oil of a main engine by means of a heat exchanger denominated as "triaxial flow". The heated coolant is then pumped through the main engine system by electrical pumps. A generator is also driven by the auxiliary engine for battery charging, etc. It is stated this system will transfer 50 KBTU/hr of thermal energy to the primary engine.

Still another approach being pursued is the use of an automatic start device which will start the inoperative engine automatically based on temperature sensing devices, or on a time cycle to preserve engine lubricants. One proposed device of this nature is reported as being under development by Maxson Corporation of St. Paul, Minn.

SUMMARY OF THE INVENTION

The invention described herein makes beneficial use of a physical effect which is usually considered as wasteful, quite a number of patents having issued, and much development work having been done, in the prevention of just this physical result. The effect referred to is the generation of heat from inefficient pumping of fluids, either from cavitation or from throttling. U.S. Pat. No. 2,720,194, Oct. 11, 1955 to Dilworth, describes a coolant circulating system for a large diesel engine, with special emphasis on a novel tank design to reduce cavitation by increasing the positive pressure on the inlet side of the coolant circulating pump. There are quite a number of patents for particular designs of centrifugal pumps to combat this very same problem, which in the current invention is turned to beneficial use.

A patent issued in the United Kingdom in 1921, No. 157,903, to Scheitlin, entitled "Mechanical Production of Heat", described the production of heat from throttling the fluid flow on the discharge side of a pump, although no specific application was described of the effect produced.

The current invention discloses a small diesel engine driving a centrifugal pump the discharge of which is throttled down or stifled so that the pump operates in a very inefficient part of its operating range, nearly at a stall. The waste mechanical energy of the back pressure and turbulence created generates heat directly in the coolant water, which is the working fluid of the system. Despite being stifled, the pump still provides sufficient rate of flow to circulate the heated coolant water through the cooling system of the primary (locomotive) engine, as well as through accessory equipment. This unconventional use of an engine-driven pump accomplishes three functions: (i) it directly induces thermal energy into the working fluid, (ii) circulates the heated fluid, and (iii) loads down the engine, increasing its heat output for additional heat transfer by conventional heat exchanger techniques. A portion of the coolant is taken directly (through a restriction) from the heating system pump to the main engine or locomotive accessories; the remaining part of the flow passes through a similar restriction then is split between the heater engine cooling jacket and an exhaust gas-to-coolant heat exchanger, after which it is injected in a reverse flow direction into the main engine block cooling passages. The heater engine operates at one of two constant speed settings, selectable according to ambient conditions.

In contrast to the systems described by Moran and Damon, mentioned previously, the engine coolant heating system (hereafter the heater) is coupled directly into the main engine cooling system plumbing, without valves or diverters. In Moran and Damon it is necessary to set valves in various flow loops every time the auxiliary system is connected to or disconnected from the main engine system. In the current invention, there are no couplings to attach or set, and the heater can be operated any time the main engine is not running, without any special precautions or check-off list. Check valves are installed to prevent damaging the heater by high pressure backflow (and to isolate the main circulating pump from the heater flow to main engine accessories). These check valves have a ¼ inch (6.3 mm) hole drilled in the flappers to allow a small circulation to prevent freezing. While not required for operation of the heater, shutoff valves may be installed in the interconnecting lines to facilitate installation or removal of the heater system.

When heater 40 operates, it will provide heated coolant to the main engine for protection; when the main engine is running, some of its coolant circulates through the samll holes in check valves 101 and 103 to provide circulation to carry heat to the heater engine 42, to keep it in ready to start condition.

While this heater system is primarily intended as a layover heater for large railroad diesel locomotives, it should also be adaptable to and usable with stationary diesels such as power generating equipment, oil-well drilling rigs and comparable large mechanical power equipment, as well as large diesel-powered vehicles such as heavy construction equipment in cold climes, and of course large highway diesels and marine applications.

The heater concept could be adapted to a power source other than a diesel engine, but it would then lose the simplicity and economy of direct coupling into the existing fuel system.

DESCRIPTION OF THE PREFERRED EMBODIMENT

Figure 1:
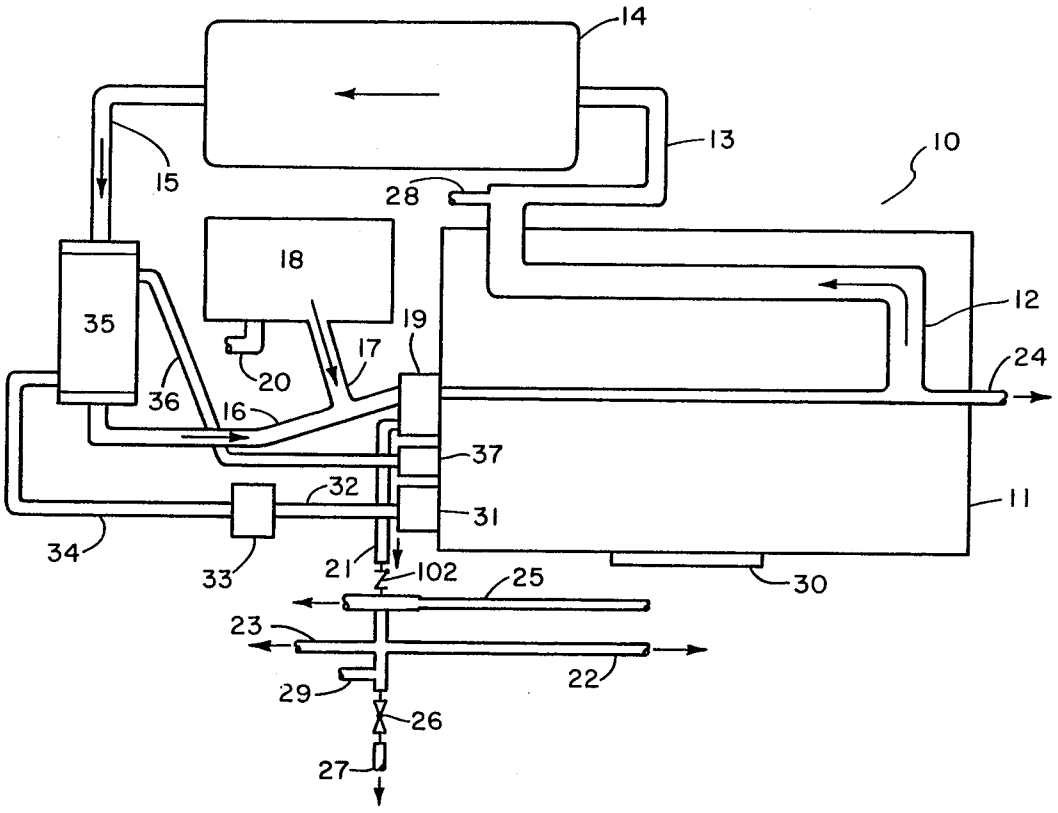
FIG. 1. A simplified functional view of a large diesel engine, in railroad configuration, showing the major elements of the cooling and lubricating systems, omitting accessories.

Referring first to FIG. 1, there are shown the fundamental elements of a large diesel engine 10. The block thereof is indicated as 11, with the internal cooling passages therein as 12. The outlet pipe 13 carries the coolant from the block to radiator 14 (only one is shown, but there may usually be two), from which the cooled water is carried by line 15 to the oil cooler 35, then by line 16 to the main coolant circulating pump 19. Makeup water from expansion tank 18 is conducted to circulating pump 19 by line 17. Indicated discharge line 24 would carry coolant to turbocharger aftercoolers in a typical installation. Line 21, also from the discharge side of the pump 19, provides for supply of coolant to accessories such as cab heaters (22) and air compressors (23). A drain valve 26 provides for draining the cooling system at drain 27. Return flow of coolant from accessories either directly or indirectly into tank 18 is indicated at line 25.

An oil sump is shown at 30, from which an oil scavenging pump 31 draws engine oil, which it pumps through line 32 to an oil filter 33, then via line 34 to oil cooler 35, from whence it is returned by line 36 to an engine oil circulating pump 37.

While not shown in the drawings for simplicity, it is part of the intent of this invention that the heater may be coupled directly into the engine oil system, and fittings are provided in the heater to allow this interconnection. The heater then may provide heat to the main engine oil while it operates, and draining and changing the two oil systems at the same time is an operational advantage.

Figure 2:
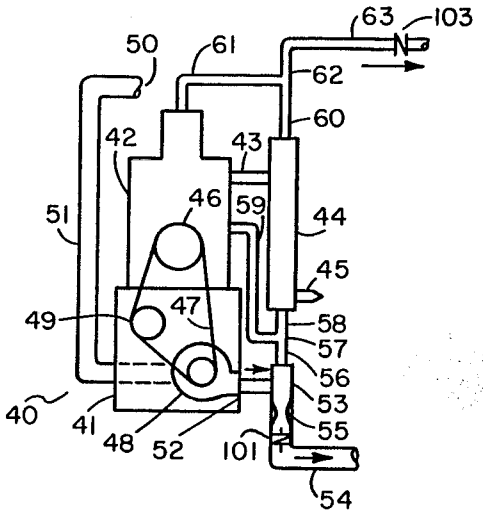
FIG. 2. The heater system of this invention, again shown in a simplified functional manner and in indicated spatial relationship with FIG. 1.

Omitting the oil system interconnection, FIGS. 1 and 2 indicate the points where the coolant systems of the main engine 10 and the heater 40 are connected. A fitting is welded into line 13 between block 11 and radiator 14 (indicated by 28, preferably located at the Y-connection which divides the flow to the two radiators, or an equivalent location) for the injection of heated coolant from the heater system 40 into block 11. It flows through the block in a reverse flow direction, at a low rate of flow, (35 gallons per minute or 132 liters/min) which still provides sufficient thermal energy to maintain safe conditions, and backflows through pump 19 to complete the flow loop. Another connection at 29 provides for injection of heated water from heater 40 into the accessory coolant pipe 21. A check valve 102 is installed in pipe 21 to prevent this accessory heater water (at a higher rate of flow than the block flow) from backstreaming through pump 19. As mentioned, check valves used in this invention have a small hole drilled through the flapper to allow sufficient flow-through for prevention of freezing. The supply of coolant water to heater 40 for heating is taken from expansion tank 18 (at 20) and is directed to flow into pipe 51 indicated at 50 in FIG. 2. Return flow is either directly or through accessories as indicated to expansion tank 18.

FIG. 2 shows a simplified functional representation of the heater system 40, in approximate spatial relation to show how it is connected to main engine 10. A frame 41 supports a two-cylinder diesel engine of constant speed characteristics, shown as 42, with its exhaust 43 feeding into heat exchanger 44 and then out through final exhaust 45. Housed within the supporting frame 41 are a centrifugal pump 48 and an alternator/inverter 49, both of which are driven by belt 47 from the crankshaft pulley 46 of engine 42.

Coolant taken from the main engine coolant expansion tank 18 at 20 (see FIG. 1) is directed to enter the heater system internal flow at 50, being led through line 51 to the suction port of centrifugal pump 48.

At pump discharge 52 the water flow is divided by tee 53, a part going through pipe 54 to accessory coolant piping as described, another portion flowing through a restriction 56 to a tee 57, which again splits the flow through 58 into heat exchanger 44 and through line 59 to the cooling jacket of engine 42.

The coolant flows emerging from heat exchanger 44 at 60 and heater engine cooling jacket 42 at 61 are joined at 62 and flow through 63, entering the main engine block cooling system through the interconnection at 28 (see FIG. 1). Check valves 101 and 103 prevent main engine coolant from backflowing through pump 48 at high pressure. The small holes in the check valves allow sufficient circulation to provide protection to components of heater 40.

As indicated previously, a feature central to this invention is the effective transfer of thermal energy by what might be considered planned abuse of an engine-driven pump, by stifling its discharge so that it is almost stalled, providing only enough pumping action for slow circulation of the coolant, while at the same time imparting heat directly into the coolant and loading down engine 42 to increase its heat output for additional transfer.

The throttling or stifling of the pump discharge is accomplished by restricting the flow in both output lines (split at tee 53) to passages with an effective orifice diameter of ½ inch (12.7 mm). The direct induction of heat into the coolant being pumped into the locomotive systems is further augmented in that branch which supplies the engine block, since the flow, after passing through line 56 (which is of reduced diameter) is further split at tee 57 and directed partly through the cooling jacket of engine 42, partly through the exhaust gas-to-coolant heat exchanger 44.

Restriction 56 induces heat directly into the coolant, but also reduces its flow velocity, which would tend to reduce the efficiency of heat transfer in the heat exchanger. As shown in the tables the relative heat transfer efficieny is lower at the higher operating speed; the greater efficiency at the lower speed being probably from more turbulent flow of the exhaust gases in the heat exchanger. The net result, however, of the restriction is an increased transfer of heat energy to the working fluid.

In the branch line (54) carrying the coolant to the locomotive accessories (shown in FIG. 3 generally as block 111) a short section of reduced diameter at 55 acts as the flow restrictor in that branch, controlling the flow to the accessories, at the same time directly imparting sufficient heat into the coolant to service the accessory systems.

Supply pipe 51 which directs the fluid input to pump 48 is a 2 inch (50.8 mm) line, and the discharge lines (neglecting the restrictions described above) are 1.25 inch (31 mm) in line 54 to the accessories, and 1 inch (25.4 mmm) in line 63 to engine block 11. The suction flow capacity, then, is greater than the discharge capacity (partly required to prevent cavitation), even without the additional restrictions to stifle the pump for direct induction of heat. The flow rate achieved is about 100 gallons per minute (gpm, about 378.5 liters/min), of which 35 gpm (132 l/m), is directed through line 63 and connection 28 to engine block 11, and 65 gpm (246 l/m) to locomotive accessories 111 through line 54 and connection 29.

Figure 3:
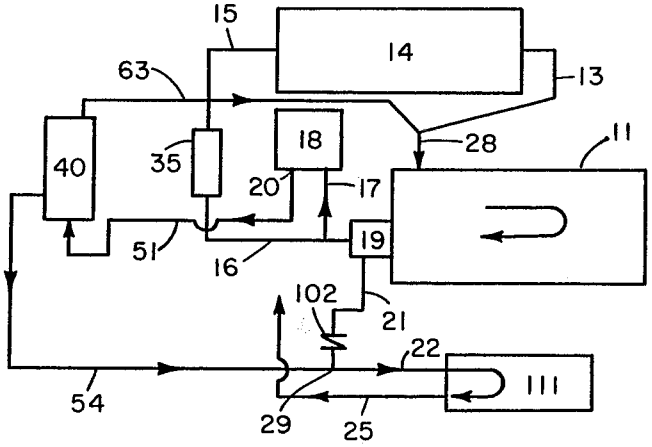
FIG. 3. Flow diagram of coolant within the two systems when the heater is operating.

FIG. 3 is a simplified flow diagram showing coolant flow while heater 40 is being operated and main engine 10 is stopped. Indicated are heater 40, providing heated coolant to block 11 through pipe 63 and connection 28 and also to vehicle or engine accessories (shown in a block as 111) through piping lines 54 and connection 29. Check valve 102, as mentioned earlier, prevents backflow through main coolant pump 19. The coolant from accessory block 111 flows through line 25 to coolant supply tank 18 (connection not shown). The coolant supply to heater 40 is taken from supply tank 18 at 20, and then directed through line 51 (entering at 50 in FIG. 2) to pump 48 (not shown in FIG. 3).

During shutdown of the main engine, radiator(s) 14 drains into supply tank 18 and there is no flow through the radiator(s), as the pressure head delivered by pump 48 is reduced by the stifling of its discharge (restriction 56), and the coolant flow is directed into the main engine block 11 through fitting 28.

The diesel engine currently used in this invention is a production two cylinder liquid-cooled model by Onan, which is designed to operate at constant speed, governor controlled, at either 1200 or 2000 revolutions per minute (rpm). The actual output power depends on the charging rate or load on the alternator/inverter, which is here shown for two different charging rates in amperes (amps), in terms of horsepower (HP) and kilowatts (Kw):

| | Power at 2.5 amps | | Power at full charge | | |
|---|---|---|---|---|---|
| Engine rpm | HP | Kw | HP | Kw | at amps |
| 2000 | 13.5 | 10.07 | 16.7 | 12.45 | 24 |
| 1200 | 5.9 | 4.4 | 6.3 | 4.7 | 5 |

An analysis based on actual test operations and calculations is given below to show how the heater produces thermal energy for transfer to the main engine system. The calculations and results are based on standard American units, and are also converted for metric equivalents as follows: #2 diesel fuel is calculated at 19,300 British Thermal Units per pound (BTU/lb) and at 10,725 Calories kg (kilocalories) per kilogram (Cal kg/kg). The thermal generation rates are shown in both BTU/hr and Cal kg/hr.

Extensive testing and analysis has been completed with the Onan engine driving a Tecumseh series 300 centrifugal pump, yielding the operational data shown below. The actual pump used is being changed to a Paco (Pacific Pumping Company) model 1570, but it is expected that the results will not change significantly.

At higher charging rates, the actual thermodynamic balance may change on a short term basis, and at extreme charging loads, there will be an increased heat output. To indicate typical operating characteristics, results at 2.5 amps charging rate and at both speeds are shown below, in the units stated before, with decimals rounded off in the conversion.

| at 2000 rpm | | | at 1200 rpm | |
|---|---|---|---|---|
| BTU/hr | CAL kg/hr | | BTU/hr | CAL kg/hr |
| 633 | 160. | a. Heat reclaimed electrically | 633 | 160 |
| 12770 | 3218 | b. Heat from inefficiency in pump (HP × 2554) | 6385 | 1609 |
| 12770 | 3218 | c. Heat as hydraulic work | 6385 | 1609 |
| 38600 | 9727 | d. Heat reclaimed in heater engine water jacket | 17000 | 4284 |
| 34217 | 8623 | e. Heat reclaimed from exhaust | 12493 | 3148 |
| 1723 | 434 | f. Heat lost in belt drive | 753 | 190 |
| 15087 | 3802 | g. Loss in exhaust, radiation and convection | 7361 | 1855 |
| 115800 | 29182 | Total | 51010 | 12855 |

Fuel input and consumption:

| | Fuel consumption | | Heat content in fuel | |
|---|---|---|---|---|
| Engine rpm | lb/hr | kg/hr | BTU/hr | Cal kg/hr |
| 2000 | 6 | 2.72 | 115,800 | 29182 |
| 1200 | 2.6 | 1.18 | 51,010 | 12855 |

Figure 5:
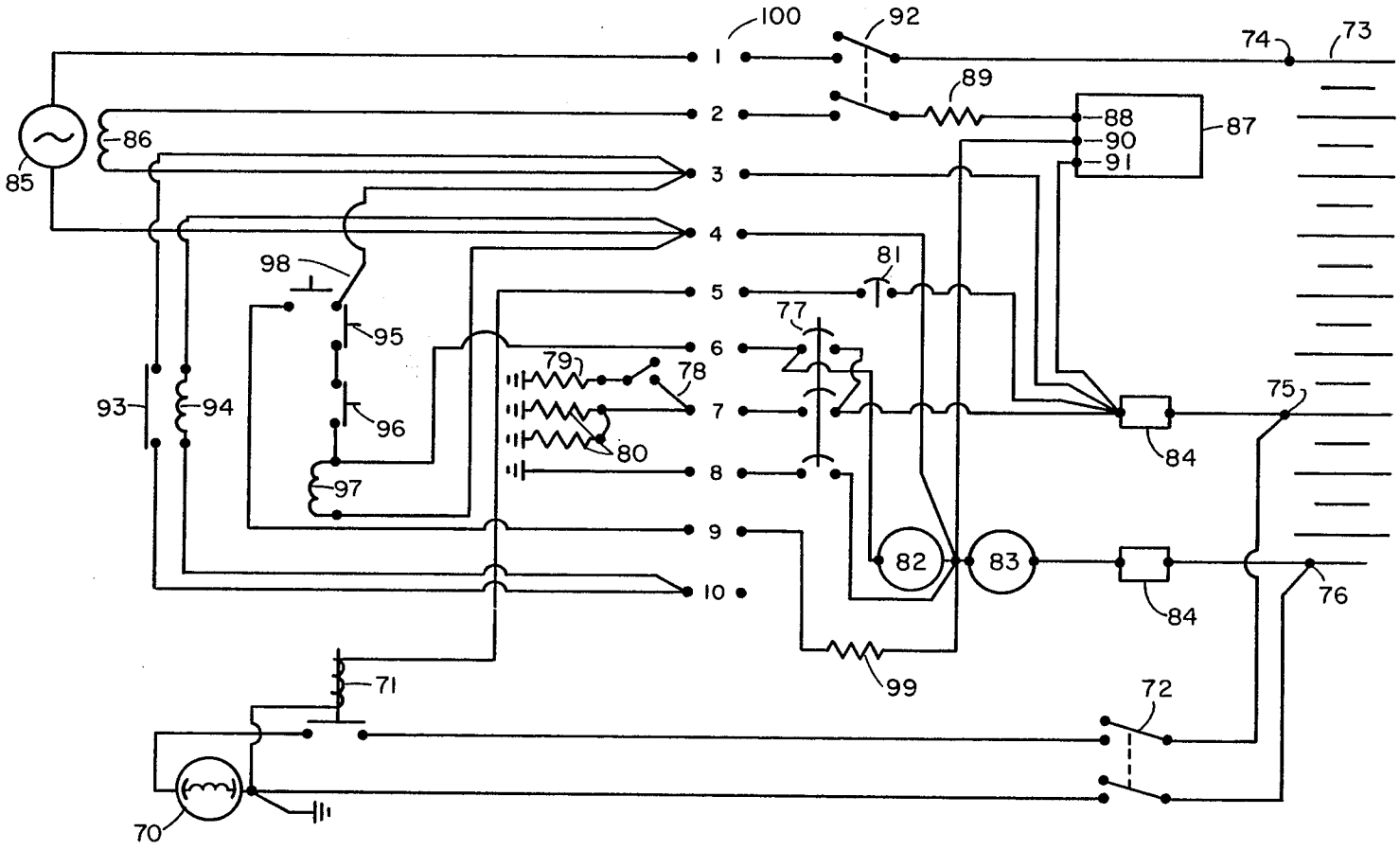
FIG. 5. A schematic of the control system for the heater.

The control system for the heater is shown in schematic form in FIG. 5. It is a relatively conventional 24 volt (v) direct current (DC) system, electrically isolated from the locomotive (or vehicle) frame except during pre-heat and start cycles. Heater starter 70 is engaged by the starting solenoid 71, which provides 24 v DC from battery 73 when energized. Starter cut-out switch 72 may be opened to de-activate the starter or to isolate it from the main electrical system. Vehicle battery 73 is a 64 v DC battery, with terminals shown at 64 v DC (74), 24 v DC (75) and 0 volts (76). To start the heater engine, pre-heat switch 77 is closed, directing 24 v DC to pre-heater element 79 (if cut-out switch 78 is closed) and glow plugs 80. After an appropriate time interval (nominally 60 seconds), start switch 81 is closed, energizing starter 70 through the solenoid 71. Two meters are provided, 82 being a running hour meter, and 84 an ammeter. Two in line 50 ampere circuit breakers 84 are provided to protect the systems against excessive current. Alternator 85, with field 86, can provide 74 v DC charging voltage to the terminals of battery 73, as controlled by voltage regulator 87. Terminals indicated in the voltage regulator as 88, 90, and 91, respectively are for providing voltage to field 86 (through dropping resistor 89, nominally 25 ohms), and for connection to the 0 volt and 24 volt points on battery 73. An alternator cut-out switch is provided as shown at 92.

Once the heater is operating, protection against either low oil or water pressure is provided by pressure activated switches 95 for oil pressure and 96 for water pressure. These switches are normally closed, providing voltage to shutdown solenoid 97, which is a latching type solenoid. If either the oil pressure or water pressure drops below set limits, one or the other of switches 95 or 96 will open, voltage to solenoid 97 will be cut off, and fuel supply to the heater engine will be cut off by operation of the shutdown solenoid 97. Switch 98 is a pressure-activated switch, normally open at proper operating oil pressures; low oil pressure will close switch 98, and provide voltage to sound alarm 99.

Thermostat 93 is preferably installed in line 13 at the (normal flow) outlet from block 11 to radiator 14 (which is the block inlet for coolant from heater 40). The thermostat 93 is normally open at operating temperatures, but will close if the coolant in which it is immersed drops below a preset temperature, providing voltage to solenoid 94, which acts on the engine governor arm to increase the spring pressure of the governor spring (not shown) and change the heater engine to its higher operating range. Indicated as 100 is the connector (10 pins) in the cable between the control box and the heater system itself.

The heater as currently configured is designed and sized as a layover heater for large railroad diesels, in particular such as the Electromotive diesel GP-40, an engine of sixteen cylinders. Any comparable engine from twelve to twenty cylinders would be within the heater's capability. For the particular engine designated, selection of one of three different thermostats will allow the heater to maintain the coolant of the main engine within three preselected ranges of temperature, depending on operating area and climate. The ranges of temperatures available are: (Model numbers shown are for Kim Hotstart thermostats).

| °Fahrenheit (°F.) | °Celsius (°C.) | Thermostat |
|---|---|---|
| 80 to 100 | 26.7 to 37.8 | ALS 810 |
| 100 to 120 | 37.8 to 48.9 | ALS 1012 |
| 120 to 140 | 48.9 to 60 | ALS 1214 |

With the specific sizes of the heater given, rates of flow as stated and in conjunction with the specified railroad diesel, the system is capable of maintaining coolant temperatures at or above safe operating temperatures (for restart) while operating at the heater engine's lower speed in conditions of temperature and wind down to those which might be characterized by a wind chill factor in the region of 0° to −5° using American measurements. Examples of conditions which produce the wind chill factor which represents the approximate lower range of conditions for operation of the heater engine at its lower speed are:

| U.S. scale | Metric equivalents |
|---|---|
| 35° F. at 50 mph wind | +1.7° C. at 80 Km/hr |
| 26° F. at 20 mph | −3.3° C. at 32 Km/hr |
| −5° F. at 5 mph | −20.5° C. at 8 Km/hr |

With no wind, the heater operating at its lower speed range should maintain safe conditions in the main engine down to temperatures in the region of −15° to −25° F. (−26° to −31.6° C.). It should be noted that in this scheme of calculation, all temperatures given are dry bulb.

In more severe conditions than those stated above, the heater engine must operate at its higher speed range, or in other words at full power. In no wind conditions, the heater is capable—at full power—of maintaining a coolant temperature in the main engine of 100° F. (37.8° C.) at ambient temperatures below −45° F. (−42.8° C.). In combined wind and low temperature conditions, the heater can maintain the desired 100° F. (37.8° C.) coolant level down to an approximate wind chill factor in the region of −60°. Examples of conditions corresponding to this chill factor (again, dry bulb temperatures), are:

| | | |
|---|---|---|
| −4° F. at 50 mph wind | (or) | −20° C . at 80 Km/hr |
| −15° F. at 20 mph | (or) | −26° C. at 32 Km/hr |
| −34° F. at 10 mph | (or) | −37° C. at 16 Km/hr. |

Figure 4:
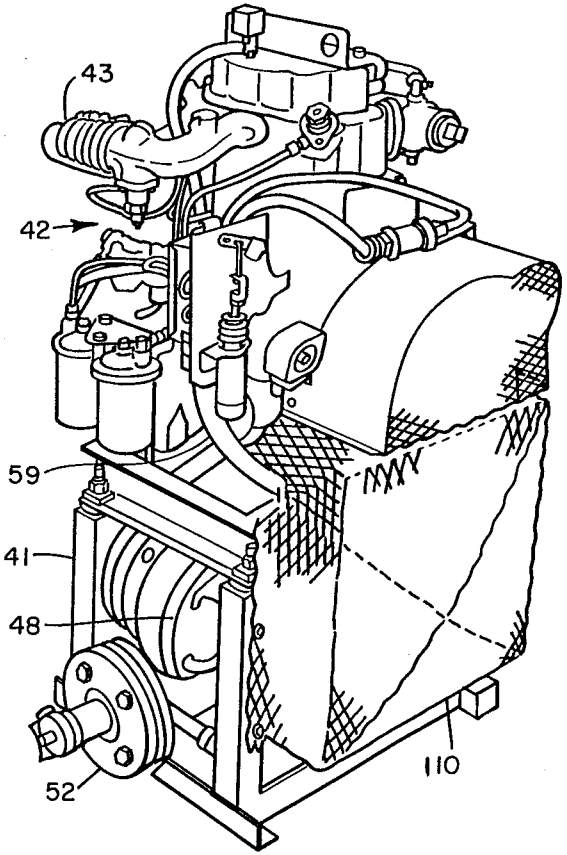
FIG. 4. Configuration of the heater system is shown, in a simplified perspective view.

FIG. 4 shows the configuration of the heater system, which in its current form as previously described to operate with the specified Electromotive GP-40 diesel has a weight of about 475 pounds (215.5 kilograms), and is about 20 by 21 inches in its horizontal dimensions and about 39 inches high (50.8×52.5×99+ centimeters). Indicated in FIG. 4 are some of the elements previously discussed functionally. Frame 41 is shown supporting small diesel engine 42 (shown in simplified outline, as it is a production engine), and housing below engine 42 and within frame 41 pump body 48 and discharge flange and port 52.

The exhaust 43 from engine 42 goes to a heat exchanger 44 (not visible in this view as it is on the back of the engine). The heat exchanger is of standard technology, but is physically configured specifically for this application. To conserve size and make the overall equipment package more compact, while yet achieving a high rate of heat transfer. 103 indicates a protective cage of extruded metal mesh or similar material covering belts 47 which drive pump 48 and inverter 49, housed beneath engine 42.

Engine 42 also provides a second drive shaft end (not shown) in FIG. 4, as it is on back side) which could be used for main engine start, air compressor drive, or other purposes. Other options are possible, such as automatic start, fuel pre-heat or other uses. The heater package is especially configured for compactness and adapted to its primary intended use, that of a layover heater for diesel locomotives. It shold be readily apparent that these components, or others of different capacity if requirements dictate, could be adapted to other diesel uses such as stationary diesel power or electrical generating equipment, large construction equipment, oil well drilling rigs (all of which may come together in oil exploration in cold regions). Other uses may easily be made of this economical and efficient apparatus for producing a beneficial result from a deliberately induced inefficiency in pumping capacity in a high capacity pump to generate useful heat to solve a long-existing problem. Parameters of mix of flow are capable of adjusting, and automatic operation can be provided.

It should be clear that further variations and modifications may be made within the scope of the disclosure, and applicant conceives that they are within the invention claimed.

Having described my invention, I claim:

1. Apparatus for providing thermal energy to the coolant in a large liquid-cooled diesel engine in cold weather conditions while said engine is not operating, said apparatus comprising:

a small liquid-cooled diesel engine mounted in cooperative relationship with said large diesel engine, and adapted to obtain its fuel from the supply provided for said large diesel engine;

pumping means driven by said small diesel engine, said pumping means being so interconnected with the cooling system associated with said large diesel engine and any accessory equipment appurtenant thereto that, when the small diesel engine and its pumping means are operating, said pumping means circulates coolant in the coolant and accessory systems of said large diesel engine, providing that restrictions are fixedly installed in the piping closely associated with the discharge of said pumping means, said restrictions acting to reduce substantially the diameter of the passage for flow of the coolant at the pump discharge, thus stifling the flow of the coolant circulated by said pumping means and converting a portion of the work done by said pumping means into heat energy absorbed into the coolant liquid, at the same time reducing the rate of flow of said coolant and increasing the work done by said small diesel engine, thereby increasing the heat generated by said small diesel engine, further providing that a portion of said coolant circulated by said pumping means, after passing through one said restriction in associated piping and having been heated thereby, is further divided by piping means and directed so as to flow partly through the engine cooling jacket of said small diesel engine and partly in a heat exchange relationship with the exhaust gases of said small diesel engine, whereby additional heat energy is imparted to said coolant, said coolant then being directed by piping means to be combined and directed to the engine cooling system of said large diesel engine, further providing that the remaining portion of said coolant flow discharged from said pumping means, after passing through a second said restriction associated with the said discharge and being heated thereby, is directed by piping means to said accessory systems associated with said large diesel engine;

further providing temperature sensing means closely associated with the coolant in said large diesel engine, governor means to control the operation of said small diesel engine at a constant speed selected from a plurality of constant operating speeds provided, and control means to select the said governor speed range based on coolant temperature.

2. Method for providing heat to the coolant of a large diesel engine in cold weather, when said large diesel engine is not operating, in which said method a small diesel engine associated with said large diesel engine drives a pumping means to circulate said coolant within said large diesel engine and any accessories appurtenant thereto, wherein the normal discharge capacity of said pumping means is stifled by means of restrictor means in the piping closely associated with the discharge of said pumping means, so that said pumping means operates inefficiently, and heat energy from said inefficient operation is imparted directly into the coolant passing through said pumping means and said associated restrictions, further providing that piping means direct a portion of said coolant to pass in a heat exchange relationship through the engine cooling jacket of said small diesel engine and another portion to pass in a heat exchange relationship with the exhaust gases of said small diesel engine, said coolant being again combined and directed by piping means to the large diesel engine.

3. Apparatus for maintaining a large diesel engine in safe restarting condition in low ambient temperatures by imparting thermal energy to the main engine coolant fluid, including centrifugal pump means driven by an auxiliary engine, said pumping means being loaded to a near stall condition by restriction means associated with the discharge lines of said pumping means so that heat energy is generated within said pump means and injected directly into the coolant being circulated by said pump means, further providing that flow of said coolant fluid circulated by said pumping means is divided so that a portion of said flow is directed through fluid passage means to a heat exchange relation with said auxiliary engine, where said flow is again divided so that a portion of said coolant fluid being circulated passes through the engine cooling jacket of said auxiliary engine, while another portion passes in a heat exchange relation with the exhaust gases from said auxiliary engine.

4. Apparatus as in claim 1 further providing that said small diesel engine also drives electrical means to provide electrical charging current to batteries associated with said large diesel engine.

5. Apparatus as in claim 4 further providing that said small diesel engine is equipped with a second power driving means for providing power for other optional purposes.

6. Method as in claim 2, further providing that restrictor means in an additional line associated with the discharge of said pumping means imparts heat energy to coolant flowing through said restrictor means, which said coolant is directed by piping means to accessory systems associated with said large diesel engine.

7. Method as in claim 6 further providing that small diesel engine also drives an electrical charging means to provide a method to maintain the batteries associated with said large diesel engine at full charge.

8. Method as in claim 2 further providing that said small diesel engine is controlled at preselected speeds by control means and temperature sensing means closely associated with the coolant in said large diesel engine.

9. Method as in claim 8 further providing that said small diesel engine is capable of providing a second powered drive shaft available for other optional purposes.

10. Apparatus as in claim 3 further providing that the portion of the coolant fluid circulated by said pumping means which is not passed through a heat exchange relation with said auxiliary engine flows through a second discharge restriction means to fluid passage means to conduct said heated coolant fluid to accessories appurtenant to said main engine.

11. Apparatus as in claim 10 further providing electrical generator means to provide charging current for batteries or accessories appurtenant to said main engine.

12. Apparatus as in claim 11 further providing that said auxiliary engine provides power for pumping and heating lubricating oil associated with said main engine.

* * * * *